US008773039B2

(12) United States Patent
Zhang et al.

(10) Patent No.: US 8,773,039 B2
(45) Date of Patent: Jul. 8, 2014

(54) DISCHARGE LAMP SYSTEM, METHOD AND APPARATUS OF CONTROLLING THE TRANSITION TIME OF DISCHARGE LAMP CURRENT CHANGE

(75) Inventors: Qi Zhang, Shanghai (CN); Wei-Qiang Zhang, Shanghai (CN); Jian-Ping Ying, Shanghai (CN)

(73) Assignee: Delta Electronics (Shanghai) Co., Ltd., Shanghai (CN)

( * ) Notice: Subject to any disclaimer, the term of this patent is extended or adjusted under 35 U.S.C. 154(b) by 131 days.

(21) Appl. No.: 13/249,272

(22) Filed: Sep. 30, 2011

(65) Prior Publication Data

US 2013/0038231 A1 Feb. 14, 2013

(30) Foreign Application Priority Data

Aug. 10, 2011 (CN) ..... 2011 1 0227967

(51) Int. Cl.
*G05F 1/00* (2006.01)

(52) U.S. Cl.
USPC ..... 315/291; 315/247; 315/307; 315/224; 315/209 R

(58) Field of Classification Search
USPC ..... 315/291, 307–311, 209 R, 224, 225, 247
See application file for complete search history.

(56) References Cited

FOREIGN PATENT DOCUMENTS

| | | |
|---|---|---|
| JP | 8-505031 | 5/1996 |
| JP | 2007-148003 A | 6/2007 |
| JP | 2007-157532 A | 6/2007 |

*Primary Examiner* — Tuyet Thi Vo
(74) *Attorney, Agent, or Firm* — CKC & Partners Co., Ltd.

(57) ABSTRACT

A method and a device for controlling a discharge Lamp, and a discharge lamp system are disclosed herein. The method includes the operations of: when the lamp current changes, determining a percentage of change of the lamp current according to a synchronous signal and obtaining a second lamp current after a discharge lamp current changes according to the percentage of change of the lamp current and a first lamp current; obtaining a modulating signal according to a current difference between the first lamp current and the second lamp current; and generating a pulse voltage signal according to the modulating signal. The pulse voltage signal transits from a first voltage to a second voltage during the time period when the lamp current is transited from a first lamp current to a second lamp current during a transition time.

24 Claims, 11 Drawing Sheets

DISCHARGE LAMP SYSTEM, METHOD AND APPARATUS OF CONTROLLING THE TRANSITION TIME OF DISCHARGE LAMP CURRENT CHANGE

RELATED APPLICATIONS

This application claims priority to Chinese Application Serial Number 201110227967.X, filed Aug. 10, 2011, which is herein incorporated by reference.

BACKGROUND

1. Technical Field

The present disclosure relates to a control mechanism of a discharge lamp, and more particularly, a method, a device and a system of controlling the discharge lamp for projection.

2. Description of Related Art

Present projection device products are full of diversities, a digital light processing (DLP) projection device, a liquid crystal projection device (LCD) and a reflective single-crystal silicon (LCOS) projection device are provided to different groups of consumers respectively. The digital light processing (DLP) projection device preferably uses discharge lamps generating light for projection, and more particularly, uses high-intensity discharge lamps (HID). In the digital light processing projection device, a color filter constructed by a color wheel with three primary colors of R, B, G (R for Red, B for Blue, G for green) rotates to pass light from light sources to sequentially generate beams of three primary colors and control spatial modulating elements simultaneously, thereby images are sequentially generated according to each of the three primary colors by time division, and color images are displayed. For a color filter of 3 colors, due to essential differences of various color lights and different requirements for brightness of various color lights, for example, if one of 3 colors appears again with different brightness comparing to other colors or if brightness in a specific image area is different from brightness in other image areas, then the requirement for the light intensity of the discharge lamp is different so that the required current of the discharge lamp is different. As shown in FIG. 1, FIG. 1 is a diagram of a discharge lamp current corresponding to each color of a color filter of 3 colors. As shown in FIG. 1, there are a difference ΔI between a discharge lamp current corresponding to B color and a discharge lamp current corresponding to R color and a difference ΔI' between a discharge lamp current corresponding to B color and a discharge lamp current corresponding to G color. On the other hand, in FIG. 1, the operation that the discharge lamp current corresponding to R color changes to the discharge lamp current corresponding to B color and the operation that the discharge lamp current corresponding to B color changes to the discharge lamp current corresponding to G color both require for a certain time period, i.e., transition time periods tr, tf, in which a previous light color changes to a latter light color during the transition time period, i.e., the intensity of light emitted by the discharge lamp would change during the transition time. Since the intensity of light emitted by the discharge lamp would change during the transition time, the light emitted by the discharge lamp during the transition time is not used for projection in order to reduce influence on quality of image, and this will result in waste of energy. Therefore, the transition time is better to be shorter to enhance the efficiency of light emitted by the discharge lamp and to save energy as well.

Therefore, how to invent a method and a device for controlling a discharge lamp and to shorten a transition time during which a discharge lamp changes from one color to another color are problems that need to solve.

SUMMARY

One aspect of the present disclosure is to control a discharge lamp for shortening the transition time and decreasing the oscillation when the lamp current changes.

The present disclosure provides a method for controlling a discharge lamp that includes a) receiving a synchronous signal; b) determining whether a lamp current of the discharge lamp changes or not according to the synchronous signal; c) when the lamp current changes, determining a is percentage of change of the lamp current according to the synchronous signal and obtaining a second lamp current after the discharge lamp current changes according to the percentage of change of the lamp current and a first lamp current before the discharge lamp current changes; d) calculating a current difference between the second lamp current and the first lamp current; e) obtaining a modulating signal according to the current difference; and f) generating a pulse voltage signal is and outputting a switch control signal according to a lamp current detecting signal, an average lamp current signal and the modulating signal so as to control the lamp current of the discharge lamp. The pulse voltage signal comprises at least a first voltage, a second voltage and a time period. The pulse voltage signal transits from the first voltage to the second voltage during the time period when the lamp current is transited from the first lamp current to the second lamp current during a transition time, and the transition time and/or current difference between the second lamp current and the first lamp current is controlled by regulating a value of the second voltage and the time period.

According to one embodiment, the second voltage is larger than the first voltage when change of the lamp current is positive going, and the second voltage is smaller than the first voltage when change of the lamp current is negative going.

According to one embodiment, the time period of the pulse voltage signal is divided into a first sub time period and a second sub time period, the pulse voltage signal comprises at least a third voltage, the pulse voltage signal changes from the first voltage to the third voltage during the first sub time period, and the pulse voltage signal changes from the third voltage to the second voltage during the second sub time period.

According to one embodiment, the third voltage is larger than the second voltage.

According to one embodiment, the third voltage is smaller than the second voltage.

According to one embodiment, the range of the time period is between about 1 microsecond (us) to 3 times the maximum of the transition time.

According to one embodiment, the first sub time period and/or the second sub time period are/is larger or equal to zero.

According to one embodiment, the transition time and/or the second lamp current is controlled by modulating the second voltage value and/or the third voltage value and/or the first sub time period and/or the second sub time period.

One aspect of the present disclosure is to provide a controlling device for controlling a discharge lamp. The controlling device comprises a microprocessor and a control circuit. The microprocessor is used to receive a synchronous signal and a lamp state detecting signal and generate an average lamp current signal and generate a modulating signal according to a difference between a second lamp current and a first lamp current. The control circuit is electrically connected to the microprocessor and used to receive a lamp current detecting signal, the average lamp current signal and the modulating signal, and generate a pulse voltage signal so as to output a switch control signal to control a discharge lamp current. The pulse voltage signal comprises at least a first voltage, a second voltage and a time period, the pulse voltage signal transits from the first voltage to the second voltage during the time period when the lamp current needs to transit from the first lamp current to the second lamp current during a transition time, and the transition time and/or current difference between the second lamp current and the first lamp current is controlled by modulating a second voltage value and the time period.

According to one embodiment, the second voltage is larger than the first voltage when change of the lamp current is positive going, and the second voltage is smaller than the first voltage when change of the lamp current is negative going.

According to one embodiment, the time period of the pulse voltage signal is divided into a first sub time period and a second sub time period, the pulse voltage signal comprises at least a third voltage, the pulse voltage signal changes from the first voltage to the third voltage during the first sub time period, and the pulse voltage signal changes from the third voltage to the second voltage during the second sub time period.

According to one embodiment, the first sub time period and/or the second sub time period are/is larger or equal to zero.

According to one embodiment, the third voltage is larger than the second voltage.

According to one embodiment, the third voltage is smaller than the second voltage.

According to one embodiment, the transition time and/or the second lamp current is controlled by modulating the second voltage value and/or the third voltage value and/or the first sub time period and/or the second sub time period.

According to one embodiment, the range of the time period is between about 1 microsecond (us) to 3 times more than maximum of the transition time.

According to one embodiment, the microprocessor includes a microprocessing unit, a first digital to analog converter, and a second digital to analog converter. The microprocessing unit includes a determining unit for determining whether a lamp current of the discharge lamp changes or not according to the synchronous signal and obtaining a percentage of change of the lamp current of the discharge lamp when the lamp current changes and a calculating unit for calculating a second lamp current of the discharge lamp and a current difference between the second lamp current and the first lamp current according to the percentage of change of the lamp current of the discharge lamp and the first lamp current of the discharge lamp, and for responsively generating a first digital signal and a second digital signal. The first digital to analog converter is used to convert the first digital signal to the average lamp current signal. The second digital to analog converter is used to convert the second digital signal to the modulating signal.

According to one embodiment, the control circuit further includes a superposition circuit for superpoing the average lamp current signal on the modulating signal so as to output the pulse voltage signal, a secondoperational amplifier having a non-inverting input, an inverting input and an output, for receiving the pulse voltage signal and the lamp current detecting signal so as to generate an error signal, and a pulse width modulation signal generator connected to the output of the first operational amplifier, for generating a switch control signal.

According to one embodiment, the control circuit further includes a lamp current processing circuit for receiving the lamp current detecting signal and the modulating signal so as to generate a pulse voltage signal, a third operational amplifier electrically connected to the lamp current processing circuit and the microprocessor to receive the pulse voltage signal and the average lamp current signal so as to generate an error signal, and the pulse modulation signal generator connected to the output of the third operational amplifier, for generating the switch control signal.

According to one embodiment, the modulating signal is obtained such that the pulse voltage signal is obtained according to a difference between the second lamp current and the first lamp current and the lamp state detecting signal, the lamp state detecting signal is a signal responsive to a lamp voltage state including lamp voltage and a duty ratio of the switch control signal.

Yet another aspect of the present disclosure is to provide a discharge lamp system. The discharge lamp system comprising a discharge lamp, a power supply device used to provide a DC power, a converter including at least a switch, electrically connected to the power supply device and the discharge lamp and used to convert the DC power to the discharge lamp current, a lamp state signal detecting circuit used to detect a lamp state of the discharge lamp to generate a lamp state detecting signal, and a controlling device which is the controlling device in another embodiment of the present invention.

According to one embodiment, the converter is a DC-DC converter.

According to one embodiment, the converter further includes a DC-AC inverter.

According to one embodiment, the lamp state detecting signal is a lamp voltage signal, a lamp current signal, a lamp power signal, the transistor duty ratio signal, an input voltage signal, an input current signal or an input power signal.

By applying the method, the device and the discharge lamp system, the pulse voltage signal required for controlling the discharge lamp to change from having a first lamp current to having a second lamp current is obtained by the lamp current and the transition time before and after the lamp current changes. When the lamp current of the discharge lamp changes from the first lamp current to the second lamp current, the pulse voltage signal for controlling the change of the lamp current transits from a first voltage to a second voltage during a time period. The transition time of change of the lamp current is significantly decreased so that unnecessary light emitted by the discharge lamp during the transition time is decreased and thus the power is saved. Furthermore, the time period that the pulse voltage signal changes is added so that the change of lamp current of the discharge lamp can become more stable.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
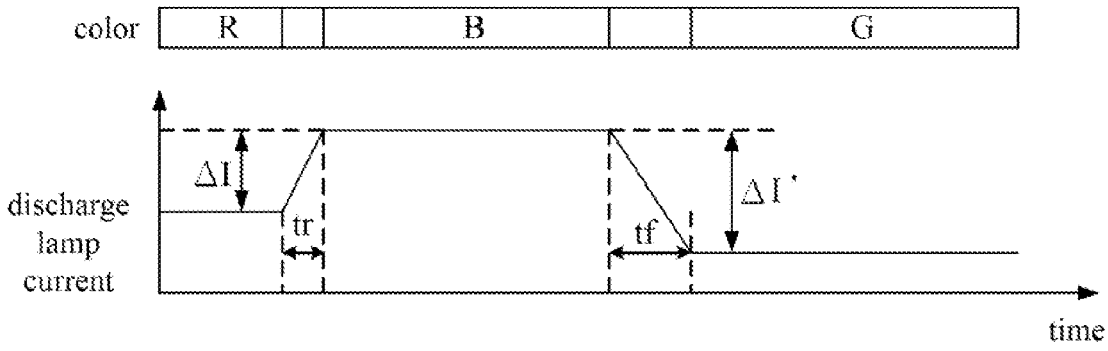
Fig. 1 (PRIOR ART)
FIG. 1 is a diagram of a discharge lamp current corresponding to each color of a color filter of 3 colors.

In the following detailed description, for purposes of explanation, numerous specific details are set forth in order to attain a thorough understanding of the disclosed embodiments. It will be apparent, however, that one or more embodiments may be practiced without these specific details. In other instances, well-known structures and devices are schematically shown in order to simplify the drawing.

Figure 2:
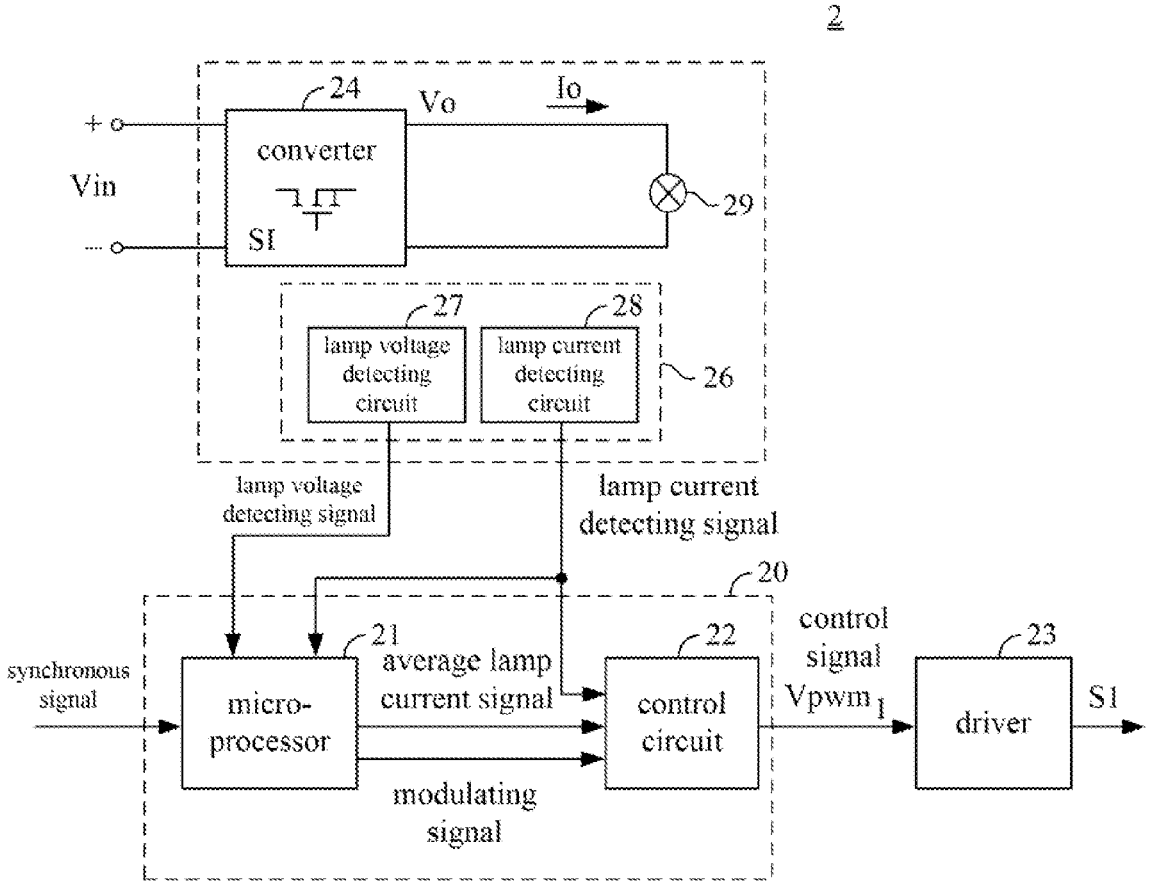
FIG. 2 is a block diagram of a system for controlling a change of lamp current of a discharge lamp according to an embodiment of the invention.

Referring to FIG. 2, FIG. 2 is a block diagram of a system for controlling a change of lamp current of a discharge lamp according to an embodiment of the invention.

As shown in FIG. 2, the discharge lamp system 2 includes a controlling device 20 (including a microprocessor 21 and a control circuit 22), a converter 24, and a discharge lamp 29. In the embodiment, an input of the converter 24 receives a DC power supply which preferably can be a DC voltage source used to provide a DC power. In one embodiment, the converter 24 is a DC-DC converting circuit including at least a first switch S1 having a terminal connected to an output terminal of the DC power supply, for converting the DC power provided by the DC power supply to the DC power required by the discharge lamp. The discharge lamp system 2 further includes a lamp state signal detecting circuit 26 including a lamp voltage detecting circuit 27 and a lamp current detecting circuit 28 used to detect a lamp voltage and a lamp current of the discharge lamp 29 respectively, so as to obtain a lamp voltage detecting signal and a lamp current detecting signal. The lamp state detecting signal received by the controlling device 20 can be a lamp voltage signal, a lamp current signal, a lamp power signal, a duty ratio signal for the first switch S1, an input voltage signal, an input current signal or an input power signal. In the embodiment, the lamp state signal received by the controlling device 20 includes a lamp voltage signal and a lamp current signal. The lamp voltage can be used to determine a state of the discharge lamp 29, i.e., determining that the discharge lamp 29 is at a constant current control stage or a constant power control stage, and also can be used to control the discharge lamp 29. In the embodiment, the microprocessor 21 of the controlling device 20 receives a synchronous signal, the lamp voltage detecting signal and the lamp current detecting signal, and obtains an average lamp current signal and a modulating signal through processing. In the embodiment, the control circuit 22 of the controlling device 20 is electrically connected to the microprocessor 21 and receives the average lamp current signal, the modulating signal outputted by the microprocessor 21 and the lamp current detecting signal and outputs a switch control signal Vpwm1 through processing. In the embodiment, the discharge lamp system 2 further includes a driver for receiving the switch control signal Vpwm1 so as to drive the at least one switch S1 of the converter 24 to switch on and off according to the switch control signal Vpwm1, thereby switching a current of the discharge lamp 29.

In the embodiment, the average lamp current signal is a signal relating to controlling the lamp power.

Figure 3:
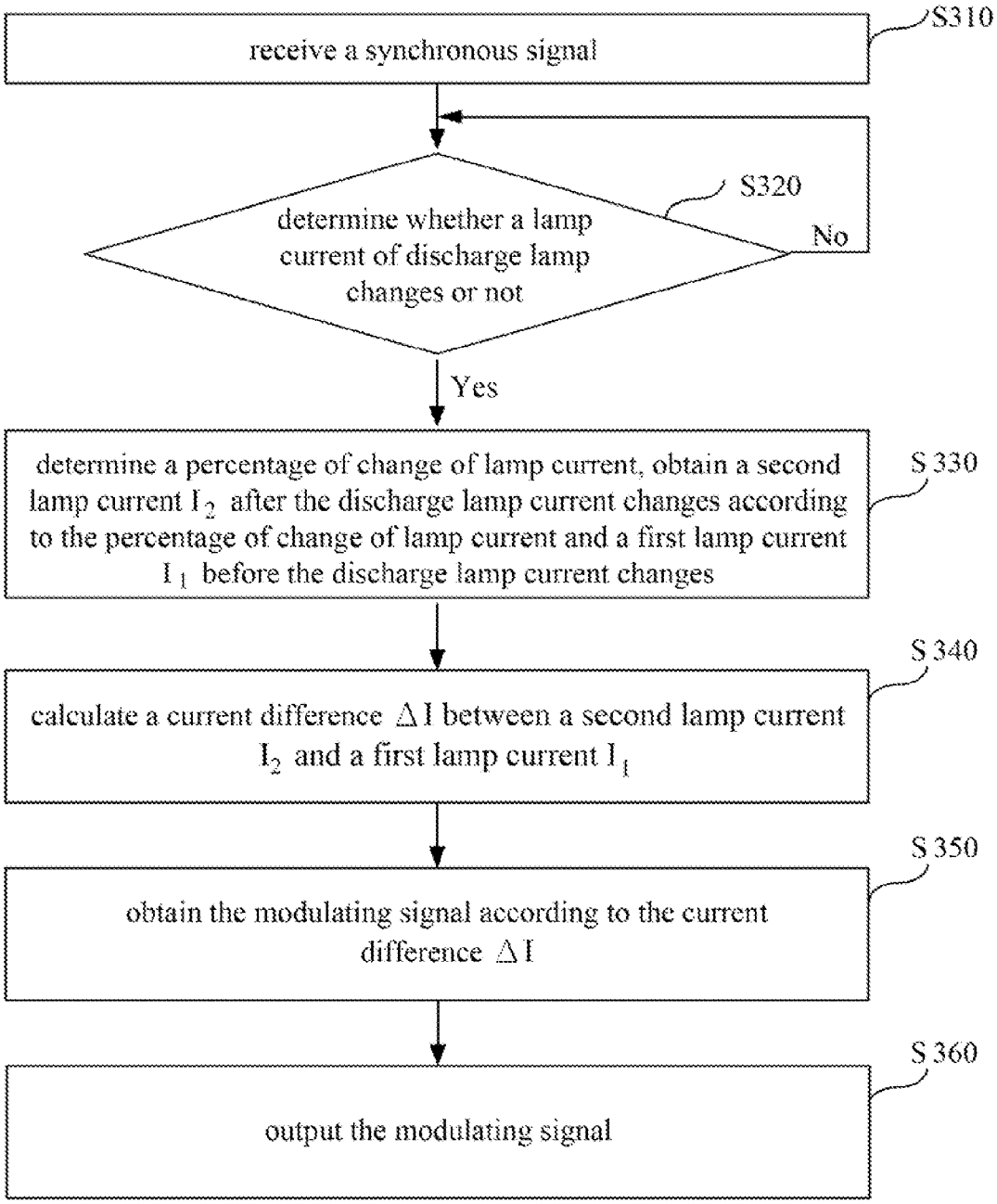
FIG. 3 is a flow chart of a method for controlling the discharge lamp according to an embodiment of the invention.

Referring to FIG. 3, FIG. 3 is a flow chart of a method for controlling the discharge lamp according to an embodiment of the invention.

As shown in FIG. 3, first, in the operation S310, a synchronous signal is received; then, in the operation S320, whether a lamp current of the discharge lamp changes or not is determined according to the synchronous signal, and the operation S330 is executed if the lamp current of the discharge lamp changes, otherwise the operation S320 is repeated; in the operation S330, a percentage of change of the lamp current is determined according to the synchronous signal, and a second lamp current $I_2$ is obtained after the discharge lamp current changes according to the percentage of change of the lamp current and a first lamp current $I_1$ before the discharge lamp current changes. Then, the operation S340 is executed, in which a current difference ΔI between the second lamp current and the first lamp current is calculated; then, the operation S350 is executed, in which a modulating signal is obtained according to the current difference ΔI. Then, the operation S360 is executed, in which the modulating signal is outputted.

In the other embodiment, in the operation S350, the lamp state detecting signal and the current difference ΔI can be combined so that the modulating signal during a process that the discharge lamp current changes from the first lamp current $I_1$ to the second lamp current $I_2$ is obtained.

The lamp state detecting signal can be a signal corresponding to the lamp state, which includes a signal corresponding to a lamp voltage, a duty ratio of a switch control signal, etc.

In the embodiment, the synchronous signal is given by the external system (e.g., a projection system), if the projection system switches R color light to B color light, a color wheel can be rotated to switch light. Meanwhile, intensity of light outputted when different colors are required is different in order to improve quality of the image, i.e., the lamp current $I_1$ is switched to the is lamp current $I_2$. In practice, the lamp current $I_1$ of the discharge lamp changes to the lamp current $I_2$ needs a certain transition time, e.g., $t_r$. Whether the lamp current changes or not and a percentage of the lamp current can be determined by the synchronous signal.

Referring to FIG. 2, in the embodiment, the modulating signal is employed with the average lamp current signal or the lamp current detecting signal such that a pulse voltage signal is obtained. In the embodiment, an amplitude of the pulse voltage signal is related to the current difference, which represents that the variation of the controlling signal required by the first lamp current $I_1$ changing to the second lamp current $I_2$.

The pulse voltage signal transits from a first voltage $V_1$ to a second voltage $V_2$ during a time period Δt when the lamp current transits from the first lamp current $I_1$ to the second lamp current $I_2$ during the transition time $t_r$. Thus, when the lamp current of the discharge lamp changes, the pulse voltage signal does not change instantaneously but transits from the first voltage V1 to the second voltage V2 during a time period Δt. Therefore, a current oscillation generated when the lamp current of the discharge lamp changes is decreased and a stable transition can be achieved. In an embodiment, a range of the time period Δt is between about 1 microsecond (us) to about 3 times of $tr_{max}$, preferably between about 10 us to about 2 times of $tr_{max}$. $tr_{max}$ is the maximum transition time allowed by the system and is related to a rotating speed of a color wheel of a projection system. For example, $tr_{max}$ is about 400 us in a projection system having a color wheel with a rotating speed of 60 Hz, and $tr_{max}$ is about 130 us in a projection system having a color wheel with a rotating speed of 200 Hz. As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

Figure 4:
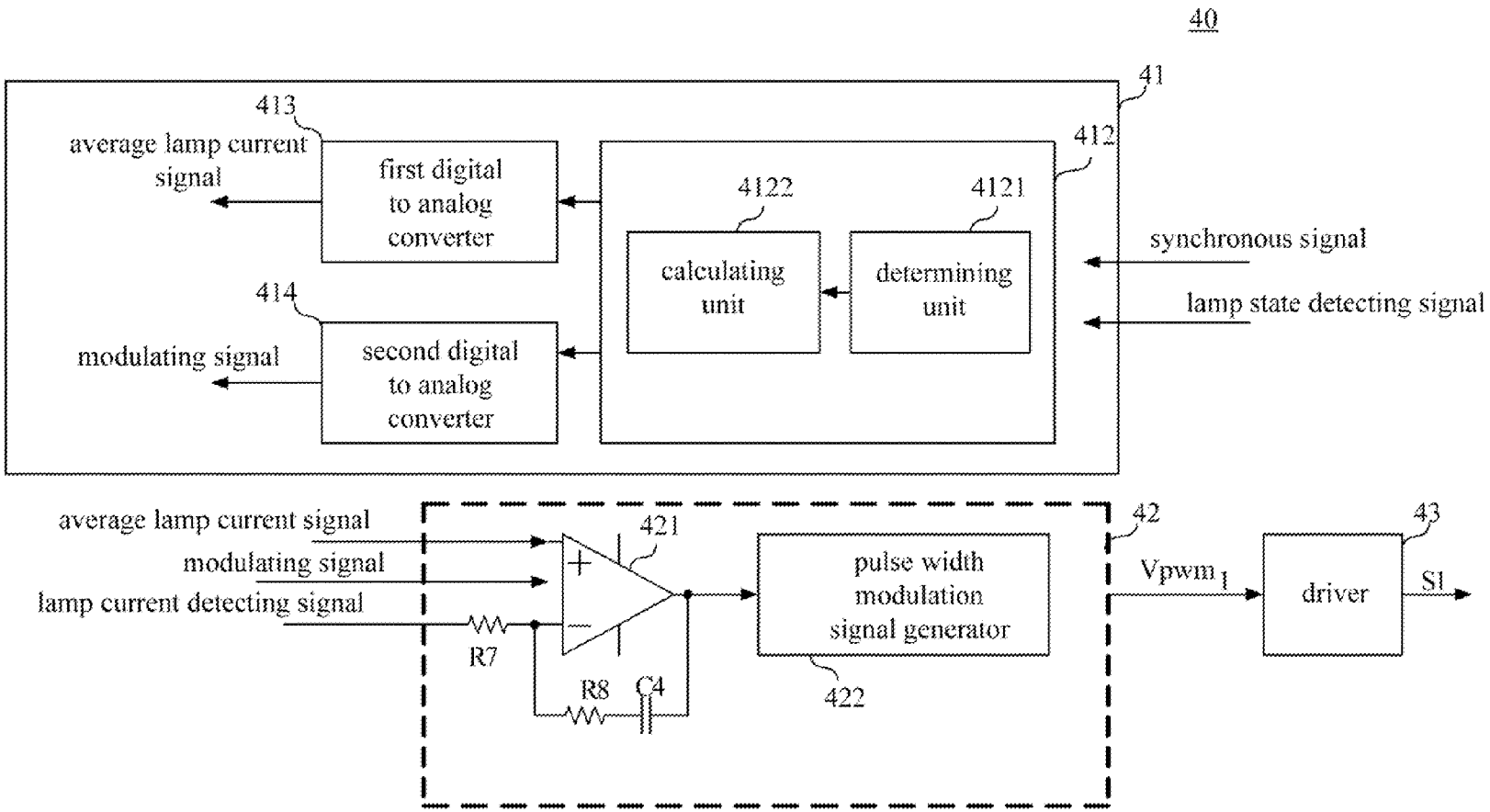
FIG. 4 is a system block diagram of a controlling device for controlling the variation of the lamp current of the discharge lamp according to an embodiment of the invention.

Referring to FIG. 4, FIG. 4 is a system block diagram of a controlling device for controlling the variation of the lamp current of the discharge lamp according to an embodiment of the invention.

As shown in FIG. 4, a microprocessor 41 of a controlling device 40 includes a microprocessing unit 412, a first digital to analog converter 413 and a second digital to analog converter 414, and a control circuit 42 of the controlling device 40 includes a first operational amplifier 421 and a pulse width modulation signal generator 422. In the embodiment, the microprocessor 41 receives the synchronous signal and the lamp state detecting signal (which can be a lamp voltage signal, a lamp current signal, a lamp power signal, a duty ratio signal for a first switch S1, an input voltage signal, an input current signal or an input power signal). The microprocessing unit 412 includes a determining unit 4121 and a calculating unit 4122, in which the determining unit 4121 is used to determine whether a lamp current of the discharge lamp changes or not according to the synchronous signal, and to obtain a percentage of change of the lamp current of the discharge lamp when the lamp current changes, and the calculating unit 4122 is used to calculate the second lamp current of the discharge lamp and the current difference ΔI between the second lamp current and the first lamp current according to the percentage of change of the lamp current of the discharge lamp and the first lamp current of the discharge lamp, and to responsively generate a first digital signal and a second digital signal. In the embodiment, the first digital to analog converter 413 and the second digital to analog converter 414 are electrically connected to the microprocessing unit 412 and used to convert the first digital signal and the second digital signal to obtain the average lamp current signal and the modulating signal, respectively. In the embodiment, the control circuit 42 is electrically connected to the microprocessor 41, receives the average lamp current signal and the modulating signal outputted by the microprocessor 41, and receives the lamp current detecting signal. The first operational amplifier 421 is used to process the average lamp current signal, the modulating signal and the lamp current detecting signal and outputs a signal (a comparing signal) as an input signal for the pulse width modulation signal generator 422, and then the pulse width modulation signal generator 422 generates a switch control signal Vpwm1 (a pulse width modulation signal). Then, the driver 43 amplifies the pulse width modulation signal and outputs the switch control signal to a switch, such that the switch control signal Vpwm1 is used to control a current of the discharge lamp.

In the embodiment, the lamp current detecting signal is inputted to an inverting input of the first operational amplifier 421, and the average lamp current signal is inputted to a non-inverting input of the first operational amplifier 421; however, it is not limiting of the present invention.

Notably, the modulating signal can not only be combined to the lamp current detecting signal that the non-inverting input of the first operational amplifier 421 receives, but also can be combined to an average lamp current signal that the non-inverting input of the first operational amplifier 421 receives.

Figure 5:
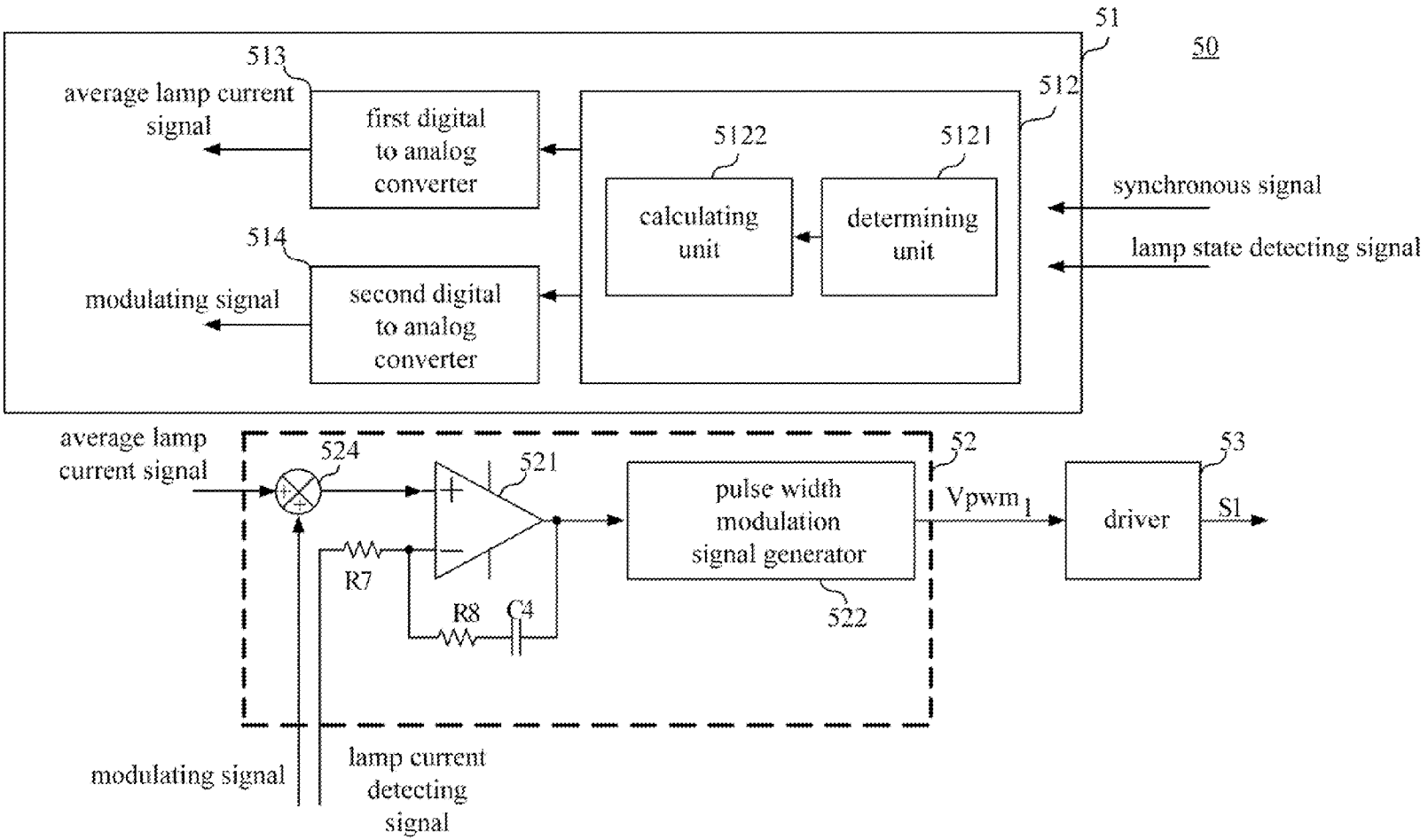
FIG. 5 is a circuit configuration diagram of a controlling device for controlling the lamp current variation of the discharge lamp.

Referring to FIG. 5, FIG. 5 is a circuit configuration diagram of a controlling device for controlling the lamp current variation of the discharge lamp. As shown in FIG. 5, a controlling device 50 includes a microprocessor 51 and a control circuit 52, in which the microprocessor 51 includes a microprocessing unit 512, a first digital to analog converter 513 and a second digital to analog converter 514. The microprocessing unit 512 includes a determining unit 5121 and a calculating unit 5122. The controlling device 50 further includes a driver 53. The operations of the microprocessor 51 and the driver 53 are the same as those of the microprocessor 41 and the driver 43 in FIG. 4, and thus it is not described for purpose of simplicity.

In the embodiment, the control circuit 52 includes a superposition circuit 524. The superposition circuit 524 is used to superpose the average lamp current signal on the modulating signal so as to generate a pulse voltage signal, i.e., the modulating signal is operated with the average lamp current signal. The control circuit 52 further includes a second operational amplifier 521 and a pulse width modulation signal generator 522. The pulse voltage signal acts as a signal that an non-inverting input of the second operational amplifier 521 receives, but it is not limiting of the present invention. The lamp current detecting signal is inputted into an inverting input of the second operational amplifier 521 through a resistor R7, but it is not limiting of the present invention. The inverting input and the output terminal of the second operational amplifier 521 are connected to each other through a PI regulator, but it is not limiting of the present invention. The second operational amplifier 521 processes an input signal inputted therein, and outputs a signal (a comparing signal) as an input signal for the pulse width modulation signal generator 522, a principle of operation of the pulse width modulation signal generator 525 has been illustrated in FIG. 4 and thus it is not described for purpose of simplicity.

Figure 5A:
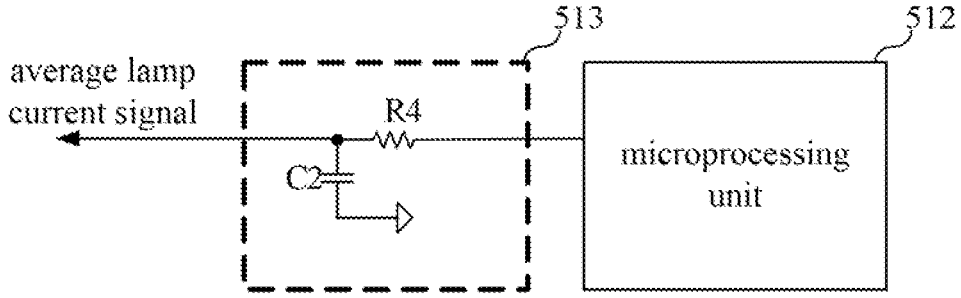
FIG. 5A is a circuit configuration diagram of a first digital to analog converter in FIG. 5.
Figure 5B:
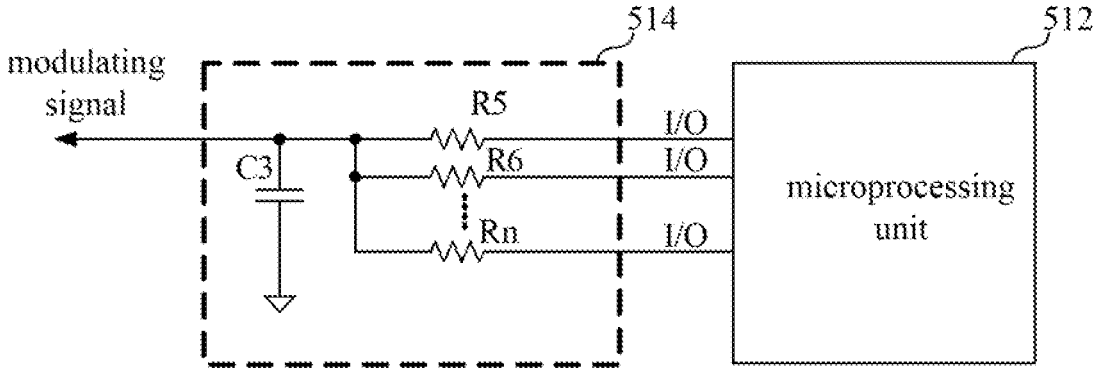
FIG. 5B shows a circuit configuration of the second digital to analog converter in FIG. 5.

In the embodiment, the first digital to analog converter 513 converts a first digital signal to an average lamp current signal. In the embodiment, the first digital to analog converter 513 is a low pass filter. As shown in FIG. 5A, FIG. 5A is a circuit configuration diagram of a first digital to analog converter in FIG. 5, in which the low pass filter is formed by a resistor R4 and a capacitor C2, but it can be other circuit configuration and it is not limiting of the present invention. The second digital to analog converter 514 processes the second digital signal to obtain the modulating signal, and in the embodiment, its circuit configuration can be as shown in FIG. 5B. FIG. 5B shows a circuit configuration of the second digital to analog converter in FIG. 5, and it can be other circuit configuration and it is not limiting of the present invention. As shown in FIG. 5B, the second digital to analog converter 514 includes several resistors R5, R6 . . . Rn and a capacitor C3, and one terminals of the several resistors are correspondingly connected to several I/O ports of the microprocessing unit 512 (the I/O ports are used to transmit the second digital signal), but it is not limiting of the present invention, and the other terminals are connected to a node. More specifically, as shown in FIG. 5B, the second digital signal is transmitted to several resistors, such as R5, R6 . . . Rn, through several I/O ports, and the resistors can be used to modulate amplitude values of output signals that I/O ports output. For example, if there are only two resistors R5 and R6 with same resistance, an output of an I/O port corresponding to the resistor R5 is a high-level signal of, for example, 5V, and an output of an I/O port corresponding to the resistor R6 is a low-level signal of, for example, 0 V, then an output signal will be a signal of 2.5V, such that the outputted modulating signal is the modulating signal with a required amplitude value. In the embodiment of the invention, the number and resistance of the resistors are not intended to be limited. Thus, signals with different voltages can be modulated from signals outputted from the I/O ports and the resistors and then be filter-processed by the capacitor C3, and then the modulating signal is obtained. In the embodiment, a terminal of the capacitor C3 is electrically connected to a node, and the other terminal of the capacitor C3 is electrically connected a ground terminal. Notably, an amplitude value of the modulating signal, which can be modulated from an output signal from the I/O port and resistors R5, R6, . . . Rn, relates to the difference of the currents.

In an embodiment, the superposition circuit 524 can be disposed inside the microprocessor 51, i.e., the microprocessor 51 outputs the pulse voltage signal, but it is not limiting of the present invention.

From the descriptions mentioned above, when the microprocessor 51 is informed of that the discharge lamp current switches from the first lamp current $I_1$ into the second lamp current $I_2$ according to the synchronous signal, the microprocessor 51 responsively outputs the pulse voltage signal, the control circuit responsively outputs the switch control signal according to the pulse voltage signal and the lamp current detecting signal, and the discharge lamp current is controlled by the switch control signal.

Figure 6A:
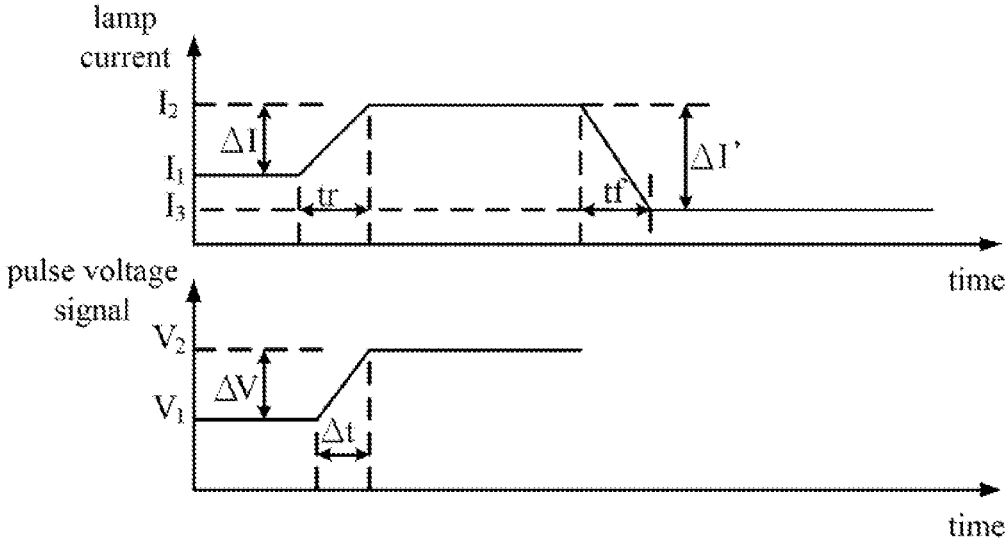
FIG. 6A is a timing diagram of the control method mentioned in FIG. 5.

Referring to FIG. 6A, FIG. 6A is a timing diagram of the control method mentioned in FIG. 5. Referring to FIG. 5 and FIG. 6A, in the embodiment, the discharge lamp current corresponding to R color light is $I_1$, a control voltage corresponding to the lamp current $I_1$ is a first voltage $V_1$, the discharge lamp current corresponding to B color light is $I_2$, a control voltage corresponding to the lamp current $I_2$ is a second voltage $V_2$, and $I_2>I_1$, $V_2>V_1$, i.e., $I_1$ to $I_2$ is positive going. Notably, in the embodiment, the positive going of the lamp current corresponds to the condition that R color light switches to B color light, but in another embodiments, it can also correspond to the condition that B color light switches to R color light, G color light switches to R color light, or G color light switches to B color light; however, it is not limiting of the present invention. Furthermore, a difference value between $I_2$ and $I_1$ is ΔI in FIG. 6A.

As described above, whether the projecting system needs to switch R color light to B color light or not can be known according to the synchronous signal given by the outer system (projection system). The color wheel can rotate to switch light, i.e., the lamp current $I_1$ is switched to the lamp current $I_2$, if the system needs to switch. In practice, the switch from the lamp current $I_1$ of the discharge lamp to the lamp current $I_2$ generally needs a certain transition time, such as tr.

In the embodiment, the discharge lamp current can be controlled to shorten the time tr of transition from $I_1$ to $I_2$ and to decrease an oscillation when the lamp current $I_1$ changes to lamp current $I_2$, i.e., the pulse voltage signal changes from the first voltage $V_1$ to the second voltage $V_2$. More specifically, the pulse signal can be controlled to gradually change from the first voltage $V_1$ to the second voltage $V_2$. As shown in FIG. 6A, the pulse voltage signal includes at least the first voltage $V_1$, the second voltage $V_2$ and a time period Δt. When the lamp current transits from the first lamp current to the second lamp current during the transition time tr, the pulse voltage signal transits from the first voltage to the second voltage during the time period Δt. Since the pulse voltage signal transits from the first voltage to the second voltage through the time period Δt, i.e., the pulse voltage signal does not change instantaneously, therefore an oscillation that the lamp current changes from the lamp current $I_1$ to the lamp current $I_2$ can be decreased. In an embodiment, when the determining unit determines the lamp current change is positive going, the second voltage is higher than the first voltage, and when the determining unit determines the lamp current change is negative going, the second voltage is smaller than the first voltage. In an embodiment, the transition time tr and/or the second lamp current can be controlled (i.e., a current difference between the second lamp current and the first lamp current is controlled) by modulating the second voltage value and/or the time period Δt, but it is not limiting of the present invention. The range of the transition time period Δt is between about 1 us to about 3 times of $tr_{max}$, and preferably, between about 10 us to about 2 times of $tr_{max}$. $tr_{max}$ is the maximum transition time allowed by the system and relates to a rotating speed of the color wheel of the projector system. For example, in the projector system including the color wheel having a rotation speed of 60 Hz, $tr_{max}$ is about 400 us, in the projector system including the color wheel having a rotation speed of 200 Hz, $tr_{max}$ is about 130 us.

Figure 6B:
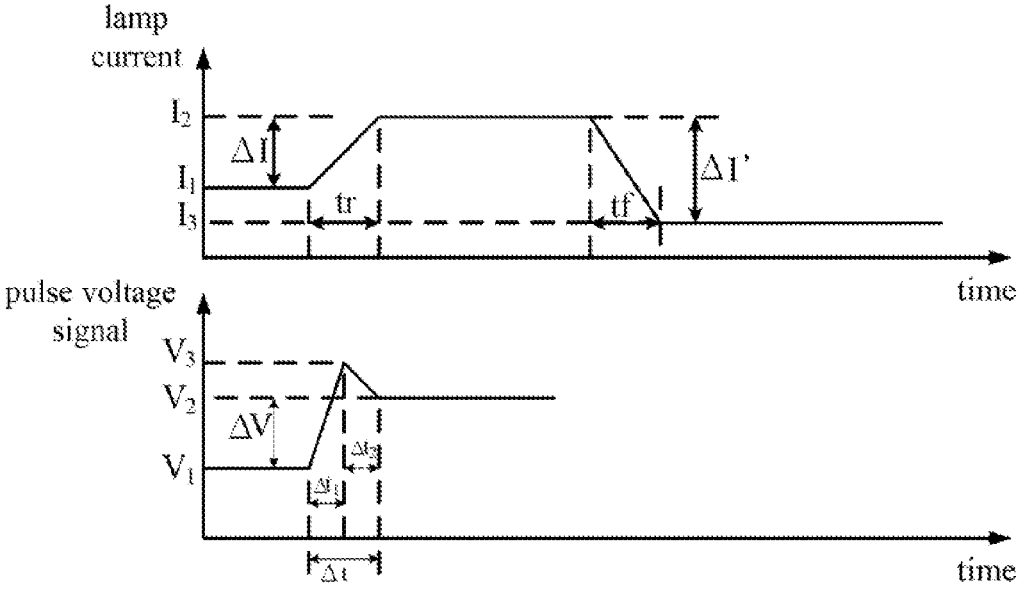
FIG. 6B is another timing diagram of the control method mentioned in FIG. 5.

Referring to FIG. 6B, FIG. 6B is another timing diagram of the control method mentioned in FIG. 5. Referring to FIG. 5 and FIG. 6B, the time period Δt of the pulse voltage signal in FIG. 6B is divided into a first sub time period Δt1 and a second sub time period Lt2, the pulse voltage signal includes at least a middle voltage, i.e., a third voltage. The pulse voltage signal changes from the first voltage to the third voltage during the first sub time period Δt1, and the pulse voltage signal changes from the third voltage to the second voltage during the second sub time period. In an embodiment, the third voltage is larger than the second voltage. In an embodiment, the third voltage is smaller than the second voltage. In an embodiment, the first sub time period Δt1 is larger than or equal to zero. In an embodiment, the second sub time period Δt2 is larger than or equal to zero. In an embodiment, when the determining unit determines that the lamp current change is positive going, the third voltage is larger than the first voltage, and the second voltage is larger than the first voltage, and when the determining unit determines that the lamp current change is negative going, the third voltage is smaller than the first voltage, and the second voltage is smaller than the first voltage. In an embodiment, the transition time and/or the second lamp current can also be controlled (i.e., a current difference between the second lamp current and the first lamp current is controlled) by modulating the second voltage value and/or the third voltage value and/or the first sub time period Δt1 and/or the second sub time period Δt2, but it is not limiting of the present invention.

Figure 6C:
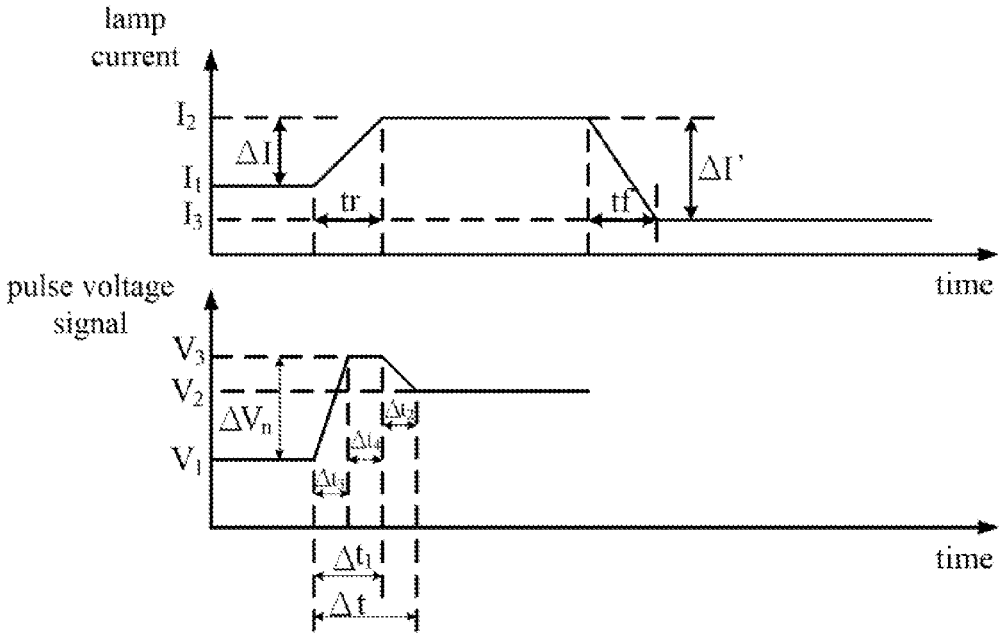
FIG. 6C is another timing diagram of the control method mentioned in FIG. 5.

Referring to FIG. 6C, FIG. 6C is another timing diagram of the control method mentioned in FIG. 5. Referring to FIG. 5, FIG. 6A, FIG. 6B and the timing diagram shown in FIG. 6C, the first sub time period Δt1 of the time period Δt of the pulse voltage signal is divided into a third sub time period Δt3 and a fourth sub time period Δt4, and the pulse voltage signal includes at least the third voltage $V_3$. In an embodiment, the pulse voltage signal changes from the first voltage to the third voltage during the third sub time period Δt3, and the pulse voltage signal maintains at the third voltage during the fourth sub time period Δt4. In an embodiment, the third sub time period Δt3 is larger than or equal to zero, and the fourth sub time period Δt4 is larger than or equal to zero. In an embodiment, the third voltage is not equal to the second voltage. In an embodiment, the pulse voltage signal changes from the third voltage to the second voltage during the second sub time period. In an embodiment, the third voltage is larger than the second voltage. In an embodiment, the third voltage is smaller than the second voltage. In an embodiment, when the determining unit determines that the lamp current change is positive going, the third voltage is larger than the first voltage, and the second voltage is larger than the first voltage, and when the determining unit determines that the lamp current change is negative going, the third voltage is smaller than the first voltage, and the second voltage is smaller than the first voltage. In an embodiment, the transition time tr and/or the second lamp current can be controlled (i.e., a current difference between the second lamp current and the first lamp current can be controlled) by modulating the second voltage value and/or the third voltage value and/or modulating the second sub time period and/or the third sub time period Δt3 and/or the fourth sub time period Δt4, but it is not limiting of the present invention. In the embodiment, the lamp current can transit from the lamp current $I_1$ to the lamp current $I_2$ faster and the transition process can be more stable by maintaining the third voltage for a time period.

Figure 6D:
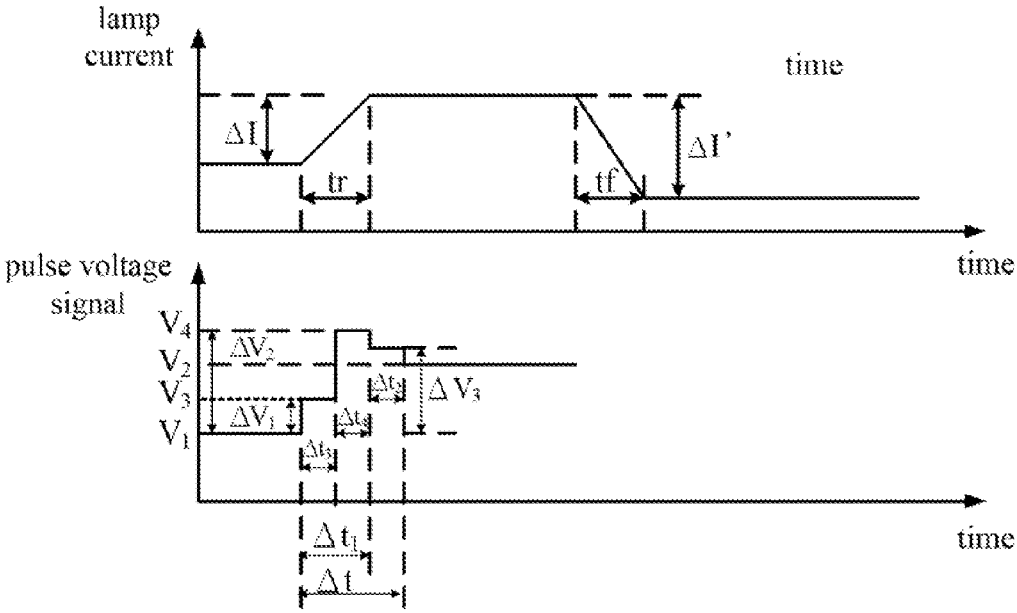
FIG. 6D is another timing diagram of the control method mentioned in FIG. 5.

Referring to FIG. 6D, FIG. 6D is another timing diagram of the control method mentioned in FIG. 5. Referring to FIG. 5, FIG. 6A, FIG. 6B, FIG. 6C, and the timing diagram as in FIG. 6D, the pulse voltage signal further includes another middle voltage, i.e., a fourth voltage. In an embodiment, the pulse voltage signal changes from the first voltage to the third voltage during the third sub time period Δt3 and maintains at the third voltage for an interval, and the pulse voltage signal changes from the third voltage to the fourth voltage during the fourth sub time period Δt4 and maintains at the fourth voltage for an interval, i.e., the pulse voltage signal step changes from the first voltage to the second voltage. In an embodiment, the third voltage and the fourth voltage are larger than the second voltage. In an embodiment, the third voltage and the fourth voltage are smaller than the second voltage. In an embodiment, the third voltage and the fourth voltage are smaller than the second voltage. In an embodiment, when the determining unit determines that the lamp current change is positive going, the third voltage and the fourth voltage are larger than the first voltage, and the second voltage is larger than the first voltage, and when the determining unit determines that the lamp current change is negative going, the third voltage and the fourth voltage are smaller than the first voltage, and the second voltage is smaller than the first voltage. In an embodiment, the pulse voltage signal can control the transition time tr and/or the second lamp current (i.e., a current difference between the second lamp current and the first lamp current can be controlled) by modulating the second voltage value and/or the third voltage value and/or the fourth voltage value and/or the second sub time period Δt2 and/or the third sub time period Δt3 and/or the fourth sub time period Δt4, but it is not limiting of the present invention.

A difference between the third voltage and the first voltage, a difference between the fourth voltage and the third voltage, a difference between the second voltage and the fourth voltage, the first sub time period Δt1, the second sub time period Δt2, the third sub time period Δt3 and the fourth sub time period Δt4 can be obtained by calculating ΔI, the present lamp state and the maximum $tr_{max}$ allowed by the system. Notably, in the present embodiment, only a middle voltage $V_3$ and/or two voltage $V_3$ and $V_4$ and the corresponding time period Δt, Δt1, Δt2, Δt3 and Δt4 are taken as an example, but in another embodiments, several middle voltages Vn and several corresponding time periods can be employed according to practical needs.

Furthermore, for the switch from the lamp current $I_2$ to the lamp current $I_3$, manners similar to those in FIG. 6A, FIG. 6B, FIG. 6C or FIG. 6D can also be applied such that the lamp current $I_2$ can be switched to the lamp current $I_3$. At that moment, the transition time is tf, and a value thereof is same as tr and not described again. At that moment, however, $I_2>I_3$, $V_2>Vn$, i.e., $I_2$ to $I_3$ is negative going. In the embodiment, it can correspond to that B color light switches to G color light, but it is not limiting of the present invention. An operation of principle thereof is similar to the description mentioned above and not described again.

Figure 7:
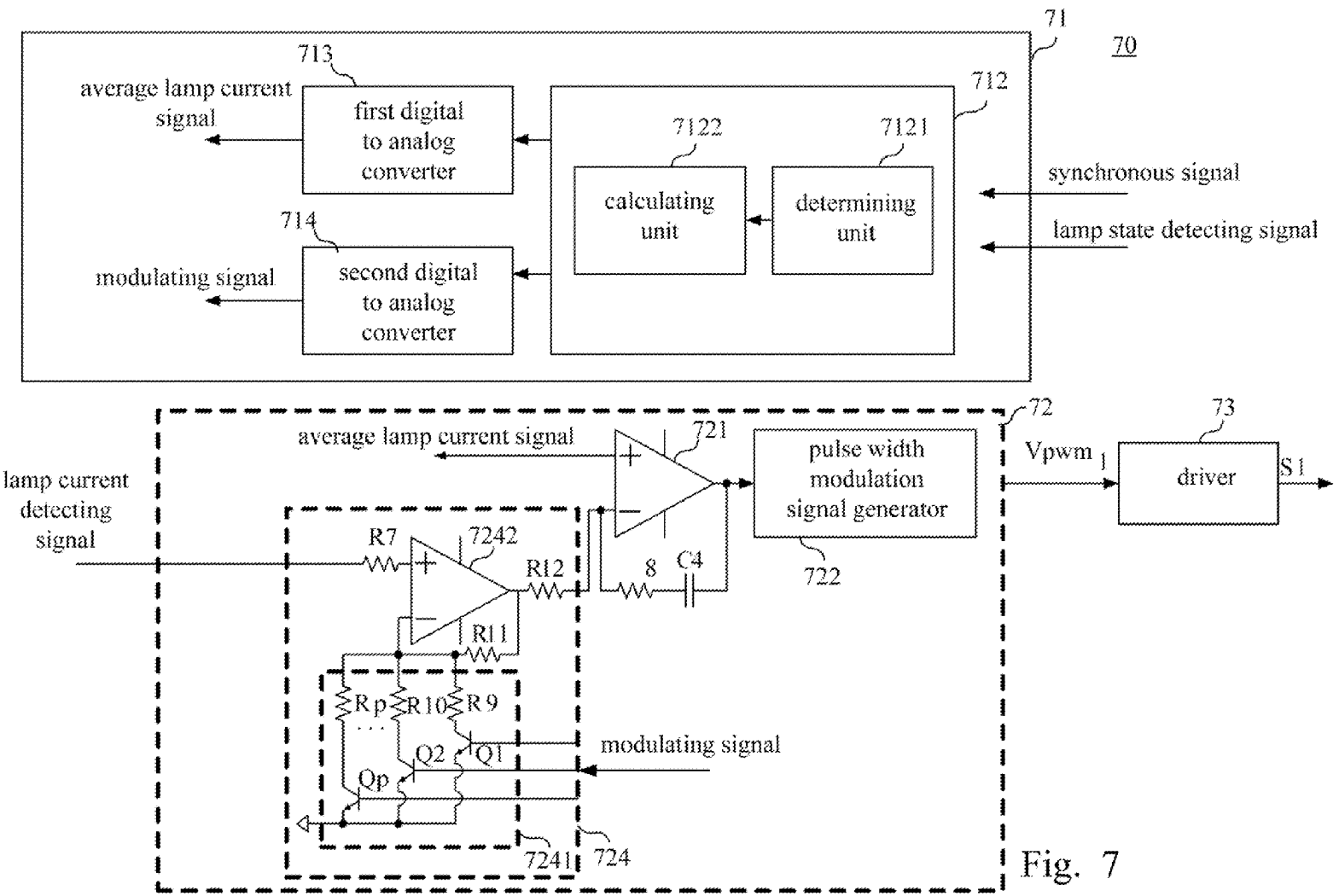
FIG. 7 is a circuit configuration diagram of a controlling device for controlling the change of lamp current of the discharge lamp according to the embodiment of the present disclosure.

Referring to FIG. 7, FIG. 7 is a circuit configuration diagram of a controlling device for controlling the change of lamp current of the discharge lamp according to the embodiment of the present disclosure. As shown in FIG. 7, the controlling device 70 includes a microprocessor 71 and a control circuit 72. In the embodiment, the microprocessor 71 receives a synchronous signal and a lamp state detecting signal, and outputs an average lamp current signal and a modulating signal. An operation of principle is similar to that of the microprocessor 41 in FIG. 4 and not described again.

In the embodiment, the control circuit 72 can include a lamp current processing circuit 724, a third operational amplifier 721, a pulse width modulation signal generator 722. The lamp current processing circuit 724 includes a gain modulating circuit 7241 and a fourth operational amplifier 7242. In the embodiment, the gain modulating circuit 7241 includes several transistors Q1, Q2, . . . , Qp, the base electrode of the transistors are correspondingly connected to several resistors R13, R14, . . . , Rm in FIG. 7A. The gain modulating circuit 7241 further includes several resistors R9, R10, . . . , Rp, one terminals of which are connected to collector electrodes of Q1, Q2, . . . , Qp, and the other terminals are connected to a node and the inverting input of the fourth operational amplifier 7242, but it is not limiting of the present invention. The inverting input of the fourth operational amplifier 7242 is connected to an output terminal of the fourth operational amplifier 7242 through a resistor R11, but it is not limiting of the present invention. A lamp current detecting signal passes through a resistor R7 and enters into a non-inverting input of the fourth operational amplifier 7242, but it is not limiting of the present invention. In the embodiment, the lamp current processing circuit 724 receives the modulating signal and the lamp current detecting signal, and a pulse voltage signal is outputted through the gain modulating circuit 7241 and the fourth operational amplifier 7242. For the third operational amplifier 721, the input signal inputted into the non-inverting input is the average lamp current signal, an input signal inputted into the inverting input is the pulse voltage signal, but it is not limiting of the present invention. The inverting input and the output terminal of the third operational amplifier 721 are connected to a PI regulator, but it is not limiting of the present invention. A principle of operation of the pulse width modulation signal generator 722 is the same as the pulse width modulation signal generator in FIG. 4 and FIG. 5. The controlling device 70 further includes a driver 73 and a principle of operation thereof is the same as the driver shown in FIG. 4 and FIG. 5 and not described again.

In other words, in the embodiment, the modulating signal is operated with the lamp current detecting signal to generate the pulse voltage signal to be compared with the average lamp current signal, so as to obtain a switch control signal Vpwm1 for controlling at least one switch to switch at least one switch on or off to control the lamp current.

Figure 7A:
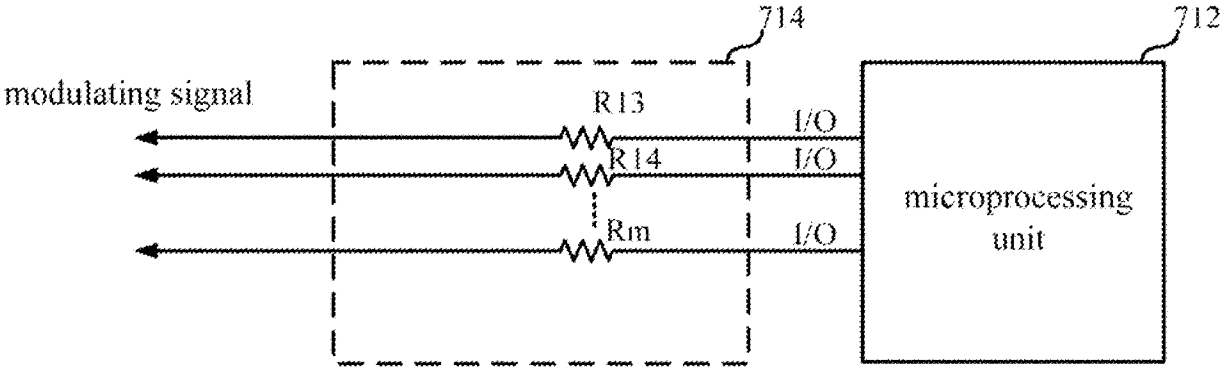
FIG. 7A is a circuit configuration diagram of the second digital to analog converter in FIG. 7.

Referring to FIG. 7A, FIG. 7A is a circuit configuration diagram of the second digital to analog converter in FIG. 7, but it can also be other circuit configurations and not limiting of the present invention. As shown in FIG. 7A, the second digital to analog converter 714 includes several resistor R13, R14 . . . Rm, one terminals of the resistors are correspondingly connected to several I/O ports (the I/O ports are used to transmit the second digital signal) of the microprocessing unit 712, but it is not limiting of the present invention. The other terminals of the resistors R13. R14 . . . Rm are connected to base electrodes of transistors Q1, Q2, . . . , Qp of the lamp current processing circuit 724 respectively. Specifically, as shown in FIG. 7, the second digital signal is transmitted through the I/O ports and the resistors to control the transistors Q1, Q2, . . . , Qp of the lamp current processing circuit 724. In the embodiment of the invention, the number and resistance of the resistors are not intended to be limited.

In the embodiment, a timing diagram of the current controlling method is similar to that shown in FIG. 6. However in the present embodiment, when a current is positive going, a change of the pulse voltage signal is the same as that when the current is negative going shown in FIG. 6. In addition, when a current is negative going, a change of the pulse voltage signal is the same as that when the current is positive going shown in FIG. 6. The operation can be referred to that shown in FIG. 5 and FIG. 6 and thus it is not described again.

Figure 8:
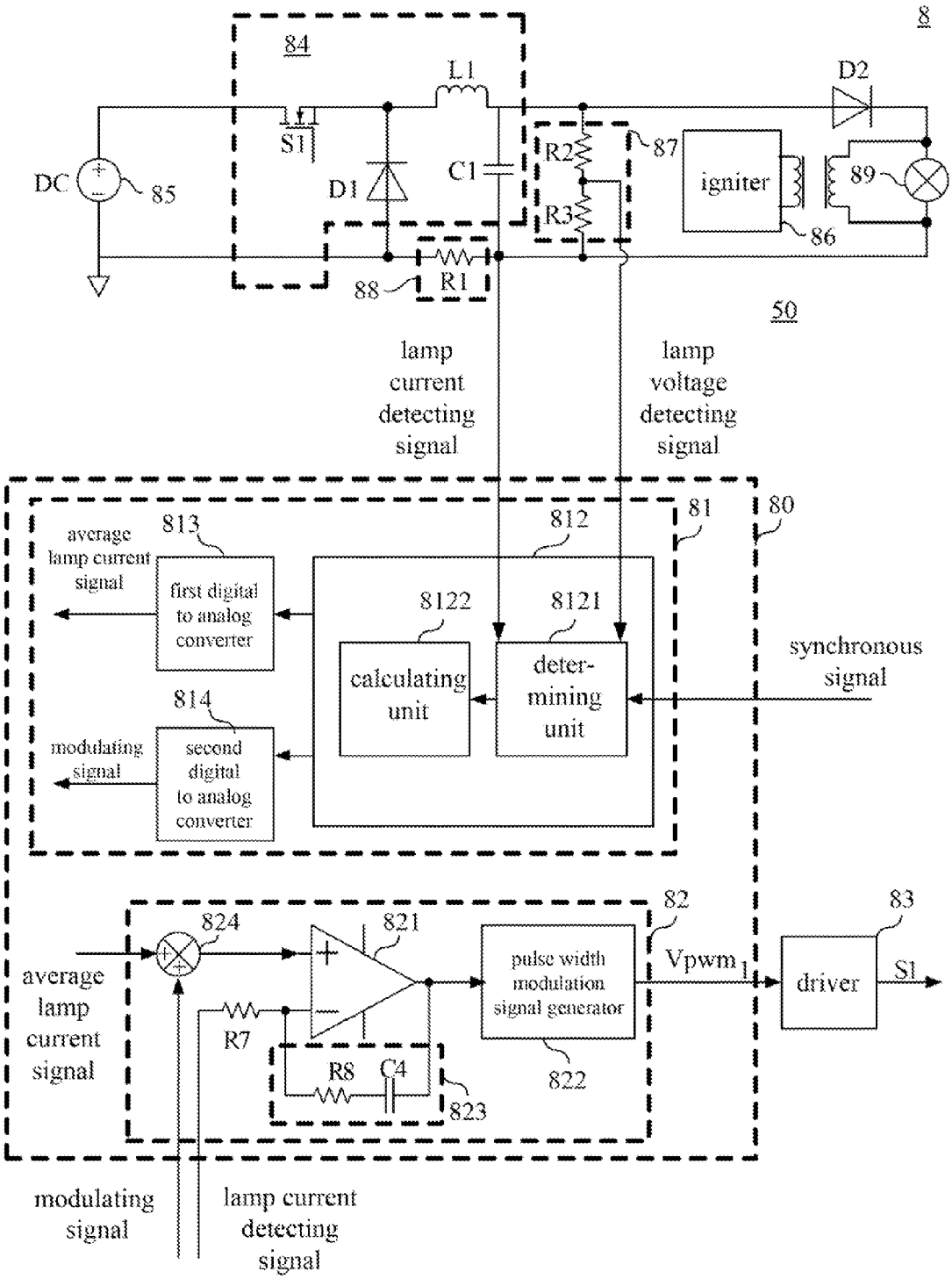
FIG. 8 is a circuit configuration diagram of a discharge lamp system in which the controlling device shown in FIG. 5 is applied.

Referring to FIG. 8, FIG. 8 is a circuit configuration diagram of a discharge lamp system in which the controlling device shown in FIG. 5 is applied. As shown in FIG. 8, the discharge lamp system 8 includes a controlling device 80 including a microprocessor 81 and a control circuit 82, a power supply device 85, a converter 84, a discharge lamp 89 and an igniter 86. In the embodiment, a construction of the controlling device 80 is the same as the controlling device 50 in FIG. 5 and not described again. The power supply device 85 can be a DC power supply, and preferably, a DC voltage source for providing a DC power. In the embodiment, the converter 84 is a DC-DC converting circuit, such as a buck circuit, a terminal of which is connected to an output terminal of the DC power supply for converting the DC power provided by the DC power supply into a DC power required by the discharge lamp. The buck circuit includes a switch S1, a diode D1, an inductor L1 and a capacitor C1. The switch S1 is controlled by the switch control signal. The switch S1 is a semiconductor device which can be an insulated gate bipolar transistor, and preferably, a metal-oxide-semiconductor-field-effect transistor. In the embodiment, the igniter 86 is connected in parallel with the discharge lamp 89 through a transformer, and the discharge lamp system 8 may further include a second diode D2 connected in series with the discharge lamp 89 for preventing a high voltage which is required by the discharge lamp 89 damaging other circuits. The lamp state signal received by the controlling device 80 can be a lamp voltage signal, a lamp current signal, a lamp power signal, a duty ratio signal for the first switch S1, an input voltage signal, an input current signal or an input power signal. In the embodiment, the lamp state signal includes a lamp voltage signal and a lamp current signal. The lamp voltage detecting signal can be obtained from a lamp voltage detecting circuit 87 having resistors R2 and R3 connected in series, but it is not limiting of the present invention. Notably, the lamp voltage can be used to determine a state of the discharge lamp 89, i.e., a constant current controlling stage or a constant power controlling stage at which the discharge lamp 89 is operated, and can also be used to control the discharge lamps 89. The lamp current detecting signal can be generated by the lamp current detecting circuit 88 consisted of a resistor R1, but it is not limiting of the present invention. In the embodiment, the controlling device 80 generates the control signal Vpwm1 according to a synchronous signal and the lamp state signal, and the process can refer to FIG. 5. In the embodiment, the switch S1 in the converter 84 switches on and off according to the controlling signal Vpwm1 to achieve the object of controlling a current of the discharge lamp 89.

In an embodiment, the discharge lamp 89 can be an AC lamp, and the converter 84 further includes an inverter for providing an AC signal required by the discharge lamp 89.

In conclusion, the present disclosure provides a controlling device and a controlling method for controlling a discharge lamp. When a lamp current of the discharge lamp needs to change from a current value to the other current value, the pulse voltage signal is controlled to change from having a voltage value to having another voltage value during a period time, and the pulse voltage signal is appropriately adjusted to reduce an oscillation during a process that a current changes and to decrease the transition time that a current value changes to the other current value.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A method for controlling a discharge lamp, the method comprising:

a) receiving a synchronous signal;

b) determining whether a lamp current of the discharge lamp changes or not according to the synchronous signal;

c) when the lamp current changes, determining a percentage of change of the lamp current according to the synchronous signal and obtaining a second lamp current after the discharge lamp current changes according to the percentage of change of the lamp current and a first lamp current before the discharge lamp current changes;

d) calculating a current difference between the second lamp current and the first lamp current;

e) obtaining a modulating signal according to the current difference; and f) generating a pulse voltage signal and then outputting a switch control signal according to a lamp current detecting signal, an average lamp current signal and the modulating signal so as to control the lamp current of the discharge lamp;

wherein the pulse voltage signal comprises at least a first voltage, a second voltage and a time period, the pulse voltage signal transits from the first voltage to the second voltage during the time period when the lamp current is transited from the first lamp current to the second lamp current during a transition time, and the transition time or current difference between the second lamp current and the first lamp current is controlled by regulating a value of the second voltage and the time period.

2. The method of claim 1, wherein the range of the time period is between about 1 microsecond (us) to 3 times the maximum of the transition time.

3. The method of claim 1, wherein the second voltage is larger than the first voltage when change of the lamp current is positive going, and the second voltage is smaller than the first voltage when change of the lamp current is negative going.

4. The method of claim 3, wherein the time period of the pulse voltage signal is divided into a first sub time period and a second sub time period, the pulse voltage signal comprises at least a third voltage, the pulse voltage signal changes from the first voltage to the third voltage during the first sub time period, and the pulse voltage signal changes from the third voltage to the second voltage during the second sub time period.

5. The method of claim 4, wherein the third voltage is larger than the second voltage.

6. The method of claim 4, wherein the third voltage is smaller than the second voltage.

7. The method of claim 4, wherein the first sub time period and/or the second sub time period are/is larger or equal to zero.

8. The method of claim 4, wherein the transition time and/or the second lamp current is controlled by modulating the second voltage value and/or the third voltage value and/or the first sub time period and/or the second sub time period.

9. A controlling device for controlling a discharge lamp, comprising:

a microprocessor for receiving a synchronous signal and a lamp state detecting signal and generating an average lamp current signal and generate a modulating signal according to a difference between a second lamp current and a first lamp current;

a control circuit electrically connected to the microprocessor, for receiving a lamp current detecting signal, the average lamp current signal and the modulating signal, and generating a pulse voltage signal so as to output a switch control signal to control a discharge lamp current;

wherein the pulse voltage signal comprises at least a first voltage, a second voltage and a time period, the pulse voltage signal transits from the first voltage to the second voltage during the time period when the lamp current needs to transit from the first lamp current to the second lamp current during a transition time, and the transition time or current difference between the second lamp current and the first lamp current is controlled by modulating a second voltage value and the time period.

10. The controlling device of claim 9, wherein the range of the time period is between about 1 microsecond (us) to 3 times more than maximum of the transition time.

11. The controlling device of claim g, wherein the microprocessor comprises:

a microprocessing unit comprising:

a determining unit for determining whether a lamp current of the discharge lamp changes or not according to the synchronous signal and obtaining a percentage of change of the lamp current of the discharge lamp when the lamp current changes; and a calculating unit for calculating the second lamp current of the discharge lamp and a current difference between the second lamp current and the first lamp current according to the percentage of change of the lamp current of the discharge lamp and the first lamp current of the discharge lamp, and for responsively generating a first digital signal and a second digital signal, a first digital to analog converter used to convert the first digital signal to the average lamp current signal; and a second digital to analog converter used to convert the second digital signal to the modulating signal.

12. The controlling device of claim 9, wherein the control circuit further comprises:

a superposition circuit for superposing the average lamp current signal on the modulating signal so as to output the pulse voltage signal;

a second operational amplifier having a non-inverting input, an inverting input and an output terminal, for receiving the pulse voltage signal and the lamp current detecting signal so as to generate an error signal; and a pulse width modulation signal generator connected to the output of the first operational amplifier, for generating a switch control signal.

13. The controlling device of claim 9, wherein the control circuit further comprises:

a lamp current processing circuit for receiving the lamp current detecting signal and the modulating signal to generate a pulse voltage signal;

a third operational amplifier electrically connected to the lamp current processing circuit and the microprocessor to receive the pulse voltage signal and the average lamp current signal so as to generate an error signal; and the pulse width modulation signal generator connected to the output of the third operational amplifier, for generating the switch control signal.

14. The controlling device of claim 9, wherein the modulating signal is obtained such that the pulse voltage signal is obtained according to a difference between the second lamp current and the first lamp current and the lamp state detecting signal, the lamp state detecting signal is a signal responsive to a lamp voltage state comprising lamp voltage and a duty ratio of the switch control signal.

15. The controlling device of claim 9, wherein the second voltage is larger than the first voltage when change of the lamp current is positive going, and the second voltage is smaller than the first voltage when change of the lamp current is negative going.

16. The controlling device of claim 15, wherein the time period of the pulse voltage signal is divided into a first sub time period and a second sub time period, the pulse voltage signal comprises at least a third voltage, the pulse voltage signal changes from the first voltage to the third voltage during the first sub time period, and the pulse voltage signal changes from the third voltage to the second voltage during the second sub time period.

17. The controlling device of claim 16, wherein the first sub me period and/or the second sub time period are/is larger or equal to zero.

18. The controlling device of claim 16, wherein the third voltage is larger than the second voltage.

19. The controlling device of claim 16, wherein the third voltage is smaller than the second voltage.

20. The controlling device of claim 16, wherein the transition time and/or the second lamp current is controlled by modulating the second voltage value and/or the third voltage value and/or the first sub time period and/or the second sub time period.

21. A discharge lamp system, comprising:

a discharge lamp;

a power supply device used to provide a DC power;

a converter comprising at least a switch, electrically connected to the power supply device and the discharge lamp and used to convert the DC power to the discharge lamp current;

a lamp state signal detecting circuit used to detect a lamp state of the discharge lamp to generate a lamp state detecting signal; and a controlling device which is the controlling device in any of claim 9 to claim 14.

22. The controlling device of claim 21, wherein the converter is a DC-DC converter.

23. The controlling device of claim 22, wherein the converter further includes a DC-AC inverter.

24. The controlling device of claim 21, wherein the lamp state detecting signal is a lamp voltage signal, a lamp current signal, a lamp power signal, the transistor duty ratio signal, an input voltage signal, an input current signal or an input power signal.

* * * * *